US007334503B1

(12) United States Patent
Newman

(10) Patent No.: US 7,334,503 B1
(45) Date of Patent: Feb. 26, 2008

(54) TOOL FOR CHANGING A LIGHT BULB

(76) Inventor: Frederick M. Newman, 8201 W. County Road 55, Midland, TX (US) 79707

( * ) Notice: Subject to any disclaimer, the term of this patent is extended or adjusted under 35 U.S.C. 154(b) by 0 days.

(21) Appl. No.: 11/515,643

(22) Filed: Sep. 5, 2006

(51) Int. Cl.
*H01K 3/32* (2006.01)

(52) U.S. Cl. ..... 81/53.11; 294/64.1

(58) Field of Classification Search ..... 81/53.11, 81/53.12, 477, 467; 294/64.1, 64.2, 64.3; 15/246.2, 414, 314
See application file for complete search history.

(56) References Cited

U.S. PATENT DOCUMENTS

| | | | | |
|---|---|---|---|---|
| 1,024,286 | A * | 4/1912 | Santilli | 81/53.11 |
| 1,311,776 | A | 7/1919 | Rodriguez | |
| 1,655,979 | A * | 1/1928 | Watkins | 81/53.11 |
| 1,847,953 | A | 3/1932 | Finesey | |
| 2,157,563 | A | 5/1939 | Pethick | |
| 2,545,043 | A | 3/1951 | Odenthal | |
| 2,573,002 | A | 10/1951 | Foster | |
| 2,637,587 | A | 5/1953 | Robinson | |
| 3,425,314 | A * | 2/1969 | Ohlson | 411/7 |
| 4,901,606 | A | 2/1990 | Christensen | |
| 5,148,723 | A | 9/1992 | Newman, Sr. et al. | |
| 5,218,889 | A * | 6/1993 | Brockberg | 72/53.11 |
| 5,881,601 | A | 3/1999 | Hammer | |
| 6,553,872 | B1 | 4/2003 | Tse et al. | |
| 6,739,220 | B1 | 5/2004 | Johnson et al. | |
| 6,826,983 | B1 | 12/2004 | Magdi | |
| 6,883,400 | B2 | 4/2005 | Sugano | |
| 6,941,841 | B2 | 9/2005 | Johnson et al. | |
| 2006/0290152 | A1 * | 12/2006 | Robinson | 294/64.1 |

* cited by examiner

*Primary Examiner*—D S Meislin
(74) *Attorney, Agent, or Firm*—Robert J. Harter

(57) ABSTRACT

A light bulb changing tool is adapted for use with a conventional vacuum cleaner whose suction nozzle is of an indeterminate diameter. In some embodiments, the light bulb changing tool includes a rotational slip joint that enables the tool to be rotated while the vacuum cleaner is stationary. In some cases, the tool includes a torque-limiting coupling that allows the tool to exert greater loosening torque than tightening torque, thereby avoiding over tightening of the bulb and ensuring that the bulb can later be removed without breakage.

8 Claims, 3 Drawing Sheets

14
12
16
8
8
52
60
62
54
10
42
50
48
18
46
44
20
28
30
32
22
24
36
34
26
14
12
10
16
52
62
58
60
42
54
56
18
50

TOOL FOR CHANGING A LIGHT BULB

BACKGROUND OF THE INVENTION

1. Field of the Invention

The subject invention generally pertains to tools for changing light bulbs and more specifically to such a tool that includes a suction cup for gripping the light bulb.

2. Description of Related Art

Various light bulb changing tools employ suction cups for gripping a light bulb. Although current light bulb changing tools with suction cups may be functional, they do have some drawbacks.

First, they have limited suction capacity. If the system has a slight air leak, the tool may lose the suction it needs for holding the bulb.

Second, if the light bulb is screwed in too tightly, the bulb may be too tight to remove, as the bulb itself can only withstand a certain amount of torque before breaking. Over tightening a bulb is particularly common because it is the dynamic coefficient of friction between the bulb and socket that opposes the tightening of the bulb; however, it is the much greater static coefficient of friction that resists the initial unscrewing of the bulb. Thus, it often takes more force to loosen a bulb than to tighten it.

Consequently, a need exists for a better light bulb changer.

SUMMARY OF THE INVENTION

To provide a better light bulb changing tool, it an object of some embodiments of the invention to use a conventional vacuum cleaner to provide the light bulb changing tool with ample suction to grip a light bulb for an extended period even if the tool leaks air.

Another object of some embodiments is to provide a light bulb changing tool that can be connected to a vacuum cleaner whose suction nozzle is of an indeterminate diameter.

Another object of some embodiments is to provide a light bulb changing tool that can exert a bulb-loosening torque that is greater that its bulb-tightening torque, thereby ensuring that the bulb can be readily unscrewed from the socket of a light fixture.

Another object of some embodiments is to provide a light bulb changing tool with a rotatable slip joint that allows the tool to be rotated relative to a generally stationary vacuum cleaner.

One or more of these and/or other objects of the invention are provided by a light bulb changing tool that includes a bi-directional torque-limiting coupling and/or a coupling that enables the light bulb changing tool to be connected to a conventional vacuum cleaner.

DESCRIPTION OF THE PREFERRED EMBODIMENT

Figures 1, 2:
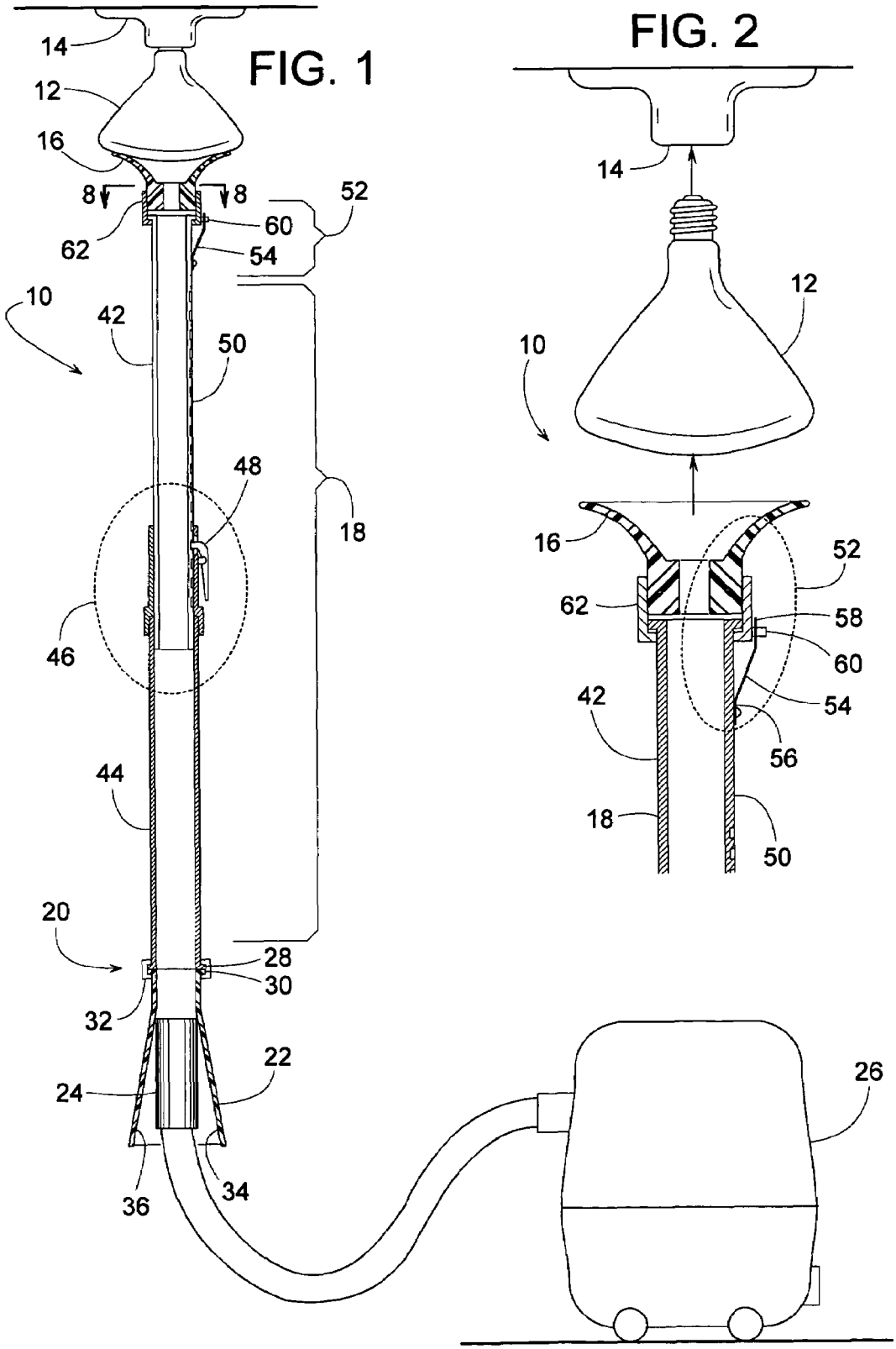
FIG. 1 is a cross-sectional side view of a light bulb changing tool according to one embodiment of the subject invention.
FIG. 2 shows the upper portion of the light bulb changing tool about to install a light bulb.
Figures 3, 4, 5:
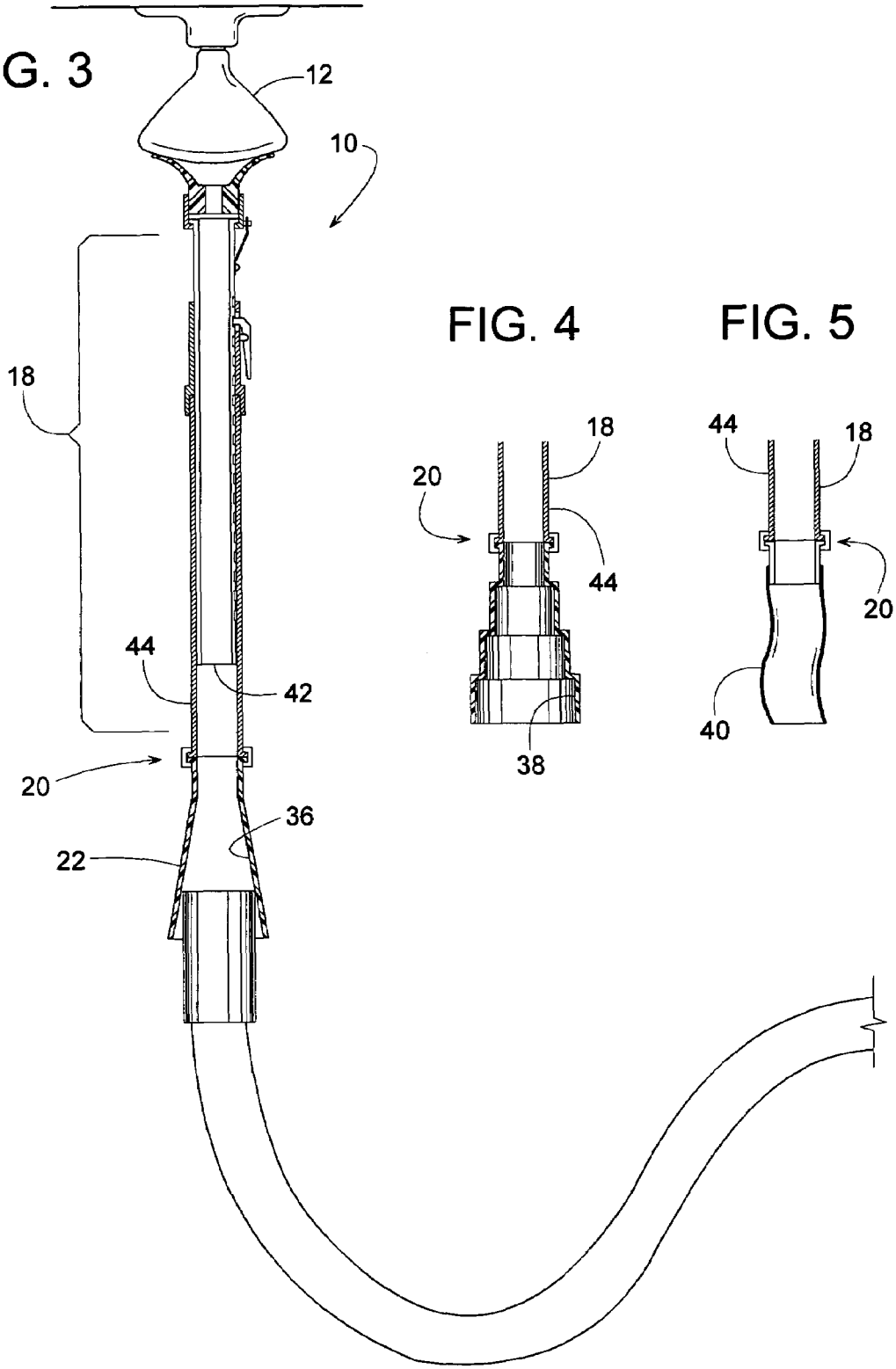
FIG. 3 is a cross-sectional view similar to FIG. 1 but showing the tool retracted and engaging a larger vacuum cleaner nozzle.
FIG. 4 is a cross-sectional view similar to FIG. 1 but showing an alternate vacuum cleaner coupling.
FIG. 5 is a cross-sectional view similar to FIG. 1 but showing yet another vacuum cleaner coupling.

A light bulb changing tool 10, shown in FIGS. 1, 2 and 3, is adapted to screw and unscrew a light bulb 12 to and from a socket 14. A bulb-gripping suction cup 16 attached to a telescoping tubular handle 18 makes tool 10 particularly suitable for changing light bulbs that are difficult to reach, such as those that screw into ceiling-mounted light sockets.

In some embodiments of the invention, tool 10 includes a rotatable slip joint 20 and a vacuum cleaner coupling 22 that can be connected to a suction nozzle 24 of a conventional electric vacuum cleaner 26. Vacuum cleaner coupling 22, slip joint 20, and tubular handle 18 connect suction cup 16 in fluid communication with vacuum cleaner 26 so that suction cup 16 can grip bulb 12 with continuous suction even if tool 10 has incidental air leaks.

Slip joint 20 enables handle 18 and suction cup 16 to rotate relative to suction nozzle 24 so that bulb 12 can be rotated without having to also rotate vacuum cleaner 26. In some cases, slip joint 20 comprises two flanges 28 and 30, which are held together axially by way of a collar retainer 30; however, other many other slip joint designs would be well within the scope of the invention.

To enable tool 10 to adapt to various suction nozzles of indeterminate diameter, vacuum cleaner coupling 22 has a suction inlet 34 of varying cross-sectional area. A varying cross-sectional area can be provided in various ways including, but not limited to, a conical inner surface 36 (FIGS. 1 and 3), a stepped inner diameter 38 (FIG. 4), or a stretchable or pliable tube 40 (FIG. 5).

Figure 6:
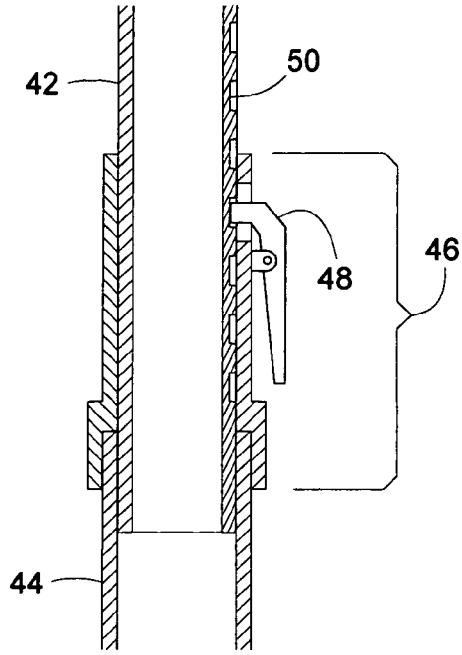
FIG. 6 is an enlarged view of the tool's locking mechanism in the locked position.
Figure 7:
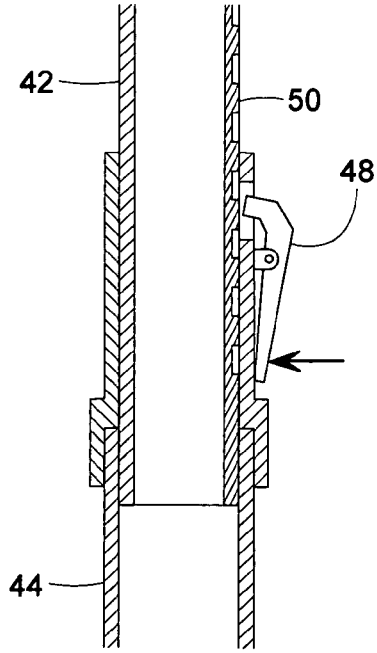
FIG. 7 is an enlarged view of the tool's locking mechanism in the unlocked position.

To adjust the length of tool 10, handle 18 can comprise two or more telescoping tubes 42 and 44. Tubes 42 and 44 are shown in an extended position in FIG. 1 and shown in a retracted position in FIG. 3. Referring further to FIGS. 6 and 7, once tubes 42 and 44 are adjusted to the desired length, a locking mechanism 46 can limit the relative axial and rotation movement of tubes 42 and 44. To limit relative axial movement of tubes 42 and 44, a spring-loaded pivotal pawl 48 coupled to tube 44 can be manually manipulated to selectively engage and disengage a gear rack 50 on tube 44 to respectively lock and unlock tube 42 to tube 44. FIG. 6 shows the locked position, and FIG. 7 shows the unlocked position. A similar locking mechanism can be found on the tubes of a model Diamante-380 vacuum cleaner, which is a product of Lindhaus of Padova, Italy. Pawl 48 engaging gear rack 50 can also be used for limiting the relative rotation between tubes 42 and 44. Relative rotation between tubes 42 and 44 can also be limited by providing tubes 42 and 44 or tube 42 and locking mechanism 46 with mating longitudinal flutes.

To avoid over tightening bulb 12 and to ensure that bulb 12 can be unscrewed from socket 14 without breakage, tool 10 preferably includes a torque-limiting coupling 52 interposed between handle 18 and suction cup 16. Torque-limiting coupling 52 has a tightening torque capacity for screwing bulb 12 into socket 14 and a loosening torque capacity for unscrewing the light bulb. The tightening torque capacity is less than the loosening torque capacity. This can be achieved by various torque-limiting mechanisms.

Figure 8:
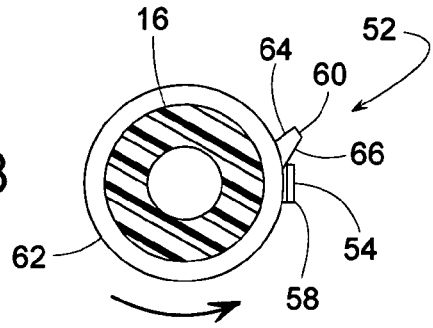
FIG. 8 is a cross-sectional view taken along line 8-8 of FIG. 1, wherein the tool is being used for tightening a bulb.
Figure 9:
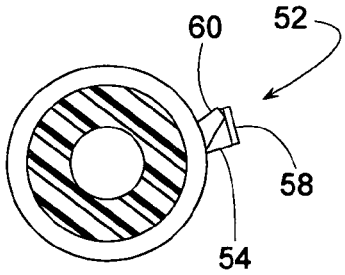
FIG. 9 is a cross-sectional view similar to FIG. 8 but showing the tool having exceeded its tightening torque capacity.
Figure 10:
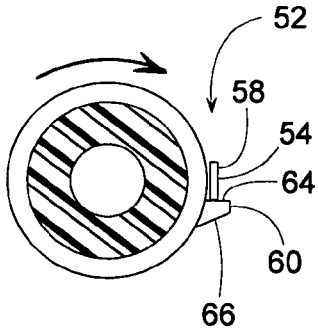
FIG. 10 is a cross-sectional view similar to FIG. 8 but showing the tool being used for loosening a bulb.

In FIGS. 2, 8, 9 and 10, for instance, coupling 52 comprises a leaf spring 54 having one end 56 attached to tube 42 and a distal end 58 that extends past a stop 60. Stop 60 is attached to a collar 62 that is fixed to the base of suction cup 16 and rotatably coupled to tube 42. Stop 60 has a blunt edge 64 and a tapered edge 66. When bulb 12 is being screwed into socket 14, distal edge 58 of spring 54 engages tapered edge 66, as shown in FIG. 8. If excessive tightening torque is applied, as shown in FIG. 9, spring 54 deflects radially outward to ride over stop 60, thereby limiting the tightening torque. When bulb 12 is being loosened, however, distal edge 58 of spring 54 engages blunt edge 64, as shown in FIG. 10. In this position, there is little if any force urging spring 54 radially outward, thus spring 54 and blunt edge 64 remain engaged so that tool 10 can exert significantly more loosening torque than tightening torque.

Although the invention is described with reference to a preferred embodiment, it should be appreciated by those of ordinary skill in the art that various modifications are well within the scope of the invention. Therefore, the scope of the invention is to be determined by reference to the following claims.

The invention claimed is:

1. A light bulb changing tool for use with an electric vacuum cleaner for changing a light bulb, wherein the electric vacuum cleaner has a suction nozzle of an indeterminate diameter, the light bulb changing tool comprising:

a suction cup defining a bulb-receiving mouth and a suction line opening leading thereto;

a tubular handle having an upper end and a lower end, the upper end is coupled to the suction cup;

a rotatable slip joint connected to the lower end of the tubular handle; and a vacuum cleaner coupling connected to the rotatable slip joint, the rotatable slip joint is interposed between the vacuum cleaner coupling and the tubular handle such that the tubular handle can rotate relative to the vacuum cleaner coupling, the vacuum cleaner coupling defining a suction inlet of varying cross-sectional area to receive the nozzle of indeterminate diameter, the tubular handle and the rotatable slip joint place the vacuum cleaner coupling in fluid communication with the suction line opening of the suction cup, thereby enabling the electric vacuum cleaner to create suction in the suction cup for gripping the light bulb while the rotatable slip joint enables the tubular handle to be rotated to rotate the light bulb.

2. The light bulb changing tool of claim 1, wherein the suction inlet includes a substantially conical surface that provides the varying cross-sectional area.

3. The light bulb changing tool of claim 1, wherein the vacuum cleaner coupling includes a pliable tube that provides the varying cross-sectional area.

4. The light bulb changing tool of claim 1, further comprising a torque-limiting coupling interposed between the tubular handle and the suction cup, the torque-limiting coupling has a tightening torque capacity for screwing in the light bulb and a loosening torque capacity for unscrewing the light bulb, wherein the tightening torque capacity is less than the loosening torque capacity.

5. The light bulb changing tool of claim 1, wherein the torque-limiting coupling includes a spring that deflects upon exceeding the tightening torque capacity.

6. A light bulb changing tool for use with an electric vacuum cleaner for changing a light bulb, wherein the electric vacuum cleaner has a suction nozzle of an indeterminate diameter, the light bulb changing tool comprising:

a suction cup defining a bulb-receiving mouth and a suction line opening leading thereto;

a tubular handle having an upper end and a lower end, the upper end is coupled to the suction cup;

a rotatable slip joint connected to the lower end of the tubular handle;

a vacuum cleaner coupling connected to the rotatable slip joint, the rotatable slip joint is interposed between the vacuum cleaner coupling and the tubular handle such that the tubular handle can rotate relative to the vacuum cleaner coupling, the vacuum cleaner coupling defining a suction inlet of varying cross-sectional area to receive the nozzle of indeterminate diameter, the tubular handle and the rotatable slip joint place the vacuum cleaner coupling in fluid communication with the suction line opening of the suction cup, thereby enabling the electric vacuum cleaner to create suction in the suction cup for gripping the light bulb while the rotatable slip joint enables the tubular handle to be rotated to rotate the light bulb;

a torque-limiting coupling interposed between the tubular handle and the suction cup, the torque-limiting coupling has a tightening torque capacity for screwing in the light bulb and a loosening torque capacity for unscrewing the light bulb, wherein the tightening torque capacity is less than the loosening torque capacity; and a spring connected to the torque-limiting coupling, the spring deflects upon exceeding the tightening torque capacity.

7. The light bulb changing tool of claim 6, wherein the suction inlet includes a substantially conical surface that provides the varying cross-sectional area.

8. The light bulb changing tool of claim 6, wherein the vacuum cleaner coupling includes a pliable tube that provides the varying cross-sectional area.

* * * * *